United States Patent [19]

Spence-Bate

[11] 4,050,687

[45] Sept. 27, 1977

[54] MICROFICHE HANDLING DEVICE

[76] Inventor: Harry Arthur Hele Spence-Bate, 1 Cheam Place, Morley, Australia, 6062

[21] Appl. No.: 715,180

[22] Filed: Aug. 17, 1976

[30] Foreign Application Priority Data

Aug. 20, 1975 Australia ..... 2858/75

[51] Int. Cl.[2] ..... B65H 5/22

[52] U.S. Cl. ..... 271/3.1; 271/94; 271/30 A; 271/117

[58] Field of Search ..... 271/3.1, 90, 94, 30 A, 271/117, 118; 354/310, 312, 315

[56] References Cited

U.S. PATENT DOCUMENTS

| | | | |
|---|---|---|---|
| 2,709,081 | 5/1955 | Welsh | 271/94 X |
| 3,720,408 | 3/1973 | Horn | 271/18 R |
| 3,827,687 | 8/1974 | Kono | 271/117 |
| 3,941,368 | 3/1976 | Munch | 271/94 X |

*Primary Examiner*—Richard A. Schacher

*Attorney, Agent, or Firm*—Fidelman, Wolffe & Waldron

[57] ABSTRACT

A device for transferring exposed microfiches from a cassette to a developing unit in which a stack of microfiches is released from the cassette into a reception chamber within a light proof casing of the device from which chamber microfiches are extracted singly and fed to an ejection opening in the exterior of the casing which is connected to the developer and into which the microfiches are fed from the ejection opening.

6 Claims, 4 Drawing Figures

MICROFICHE HANDLING DEVICE

The present invention relates to devices for handling microfiches.

At present the transfer of exposed microfiches from a cassette to a developing unit is done by hand under darkroom conditions. Such handling necessitates careful attention by a laboratory technician and the provision on the premises of a darkroom.

It is an object of the present invention to reduce or eliminate the need for a specialised technician and eliminate the necessity for a darkroom.

According to the invention there is provided a device for handling microfiches comprising a light proof container, reception means for receiving a microfiche cassette on or in the container including a light proof reception opening, a microfiche receiving chamber capable of receiving a stack of microfiches from the reception means, an ejection opening in the container including a light proof seal, extraction means for removing the microfiches singly from the chamber and feeding the microfiches singly to the ejection opening for ejection into a developing unit.

In one embodiment of the invention a clamping means is provided for clamping a said stack of microfiches held in the receiving chamber so that whilst a single microfiche has been removed from the stack for feeding to the ejection opening, no further microfiche can be removed from the stack. Preferably, the chamber is pivotally mounted towards one end adjacent the reception means on one end of a lever which is pivotally mounted at its other end to a static part of the device, wherein the lever is biassed by means of a resilient means to engage with a cam, and wherein a fixed clamping surface is provided onto which the resilient means biasses the chamber to form the clamping means whereby the cam when rotated separates the chamber from the clamping surface to release a microfiche. A tilting arm may be provided to overcome the bias of the resilient means and tilt the chamber into line with the reception means for the reception of a said stack from a said cassette. Preferably the cam and extraction means are driven from a motor which can be energised by an electrical circuit in the developer when the developer is ready to receive microfiches. The extraction means is preferably one or more rollers located adacent the clamping surface.

In a second embodiment of the invention the extraction means comprises a rotatable vacuum sucker which is mounted adjacent the receiving chamber so as to engage a single microfiche from a said stack in the chamber, whereby the sucker rotates to extract microfiches from the camber and projects the microfiches singly to the ejection opening.

The invention will now be described with reference to the accompanying drawings, in which.

Figure 1:
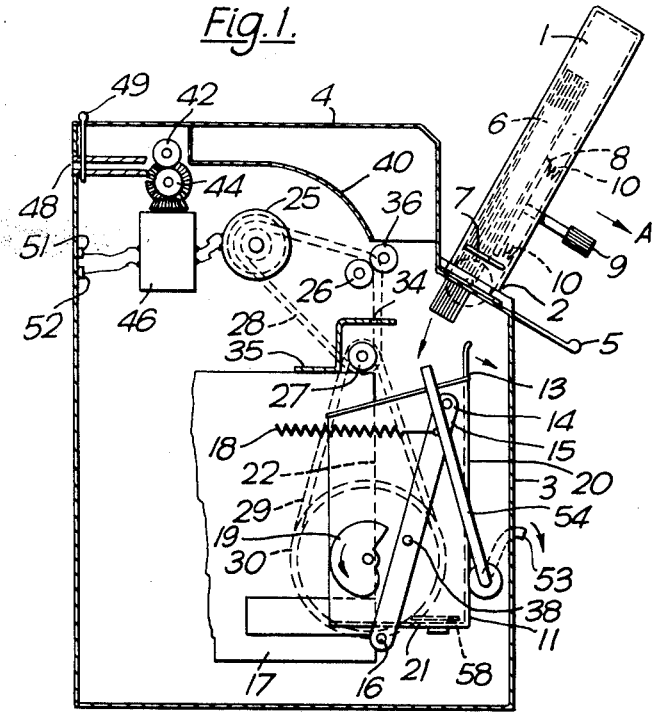
FIG. 1 is a diagrammatic cross-section of one handling device according to the invention showing the insertion of a stack of microfiches from a cassette.

In the embodiment shown in FIG. 1 a cassette 1 is inserted into a light proof reception opening or receiving means 2 in the casing 3 of a handling device shown generally at 4. The reception opening 2 has a light proof slide 5 which is opened to allow a stack 6 of microfiches to drop into the device 4. The cassette 1 has a further light proof slide 7 which is also opened to allow the stack 6 to drop into the device 4. Within the cassette 1 a plate 8 presses the stack 6 into a tight form. The plate 8 is released by means of a knob 9 which when pulled outwards in the indicated direction A, overcomes the tension of plate pressure springs 10 and allows the stack to drop neatly into a microfiche receiving chamber 11. The cassette 1 is clamped into the opening 2 by means of a clamping screw 12.

The chamber 11 is pivotally mounted towards one end 13 adjacent the reception opening 2 on a pivot rod 14 extending from one end of a lever 15. The lever 15 is pivotally mounted at its other end on a pivot 16 on a static part 17 of the device 1.

Figure 2:
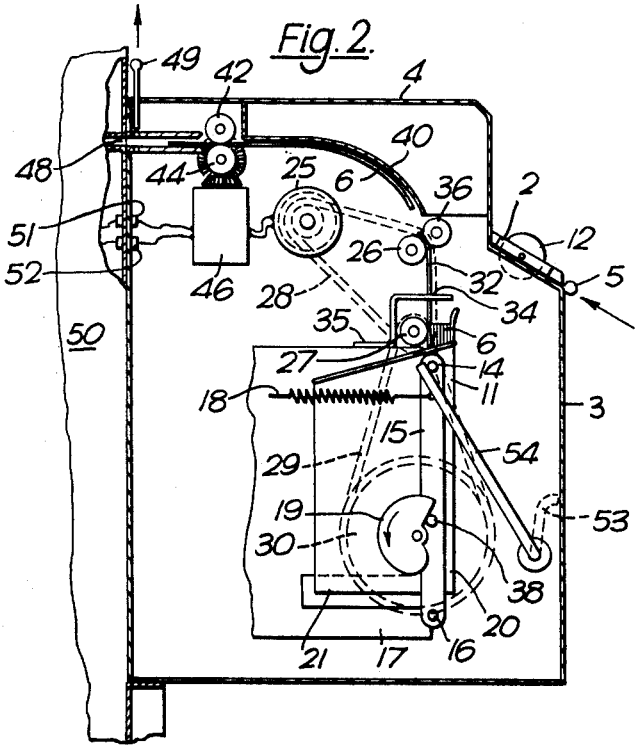
FIG. 2 is a further view of FIG. 1 showing the ejection of a microfiche from a received stack.
Figure 3:
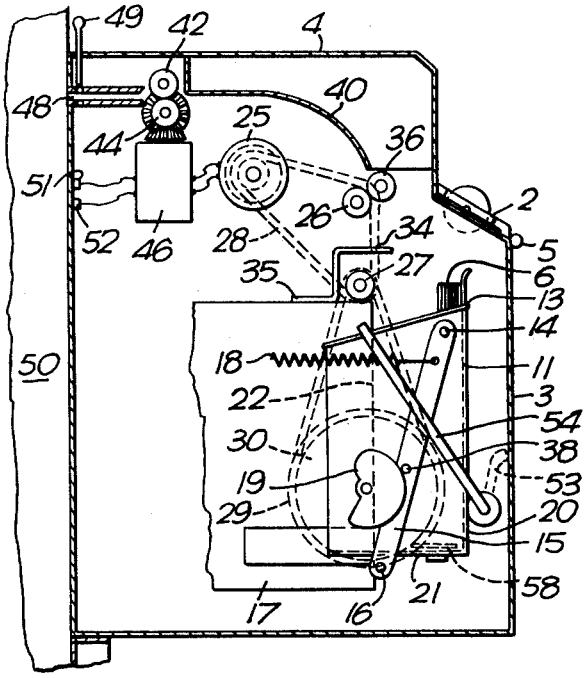
FIG. 3 is a further view of FIG. 1 showing the disengagement of the stack from an extraction means, and, FIG. 4 is a second handling device according to the invention showing the insertion of a stack of microfiches and extraction of a single microfiche therefrom.

The lever 15 is biassed by means of a spring 18 to engage wih a cam 19 so that the chamber normally takes up the position as shown in FIG. 2 where the stack 6 is held by a back plate 20 and bottom plate 21 of the chamber 11 into engagement with a fixed clamping surface 22 which can best be seen as a broken line in FIG. 1. When filling the chamber 11 from the cassette handle 53 on the exterior of the casing is depressed which causes arm 54 to engage on pin 14 and tilts the chamber 11 into the position shown in FIG. 1 toward the opening 2.

When it is required to extract a single microfiche from the stack 6, the cam 19 is rotated by means of a motor 25 which drives extraction rollers 26 and 27 by means of a belt 28 and thence by means of a further belt from roller 27 to a cam pulley 30 connected to cam 19. As the cam 19 rotates the roller 27 forming part of the extractions means also rotates and starts to pull a microfiche 32 from the stack 6. The microfiche 32 passes through a gate 34 in plate 35 to roller 26 and an opposed roller 36. At this stage the back plate 20 of the chamber 11 still holds the stack into engagement with clamping surface 22 which is coated with a smooth surface material such as "Teflon" (Registered Trade Mark). Shortly after the cam 19 acts on a pin 38 on lever 15 and pushes against the spring 18 to release the clamping effect of plate 20 on surface 22. The prevents a further microfiche being removed from the stack 6.

After extraction by rollers 26 and 36 the microfiche 32 is moved up a curved plate 40 to ejection rollers 42 and 44 driven by a further motor 46. The rollers 42 and 44 eject the extracted microfiche from the device 4 through an ejection opening 48 which is sealed in FIG. 1 by a light seal shutter 49 into a developing unit 50.

The developing unit may provide the power source for the motoring 46 and 25 so that when the developer is ready electrical power is passed through contacts 51 and 52 on the casing of the device to the motors 46 and 25.

A chamber empty indicating device 58 may be provided on the base plate 21 in the form of a pressure plate which makes or breaks an electrical circuit.

Figure 4:
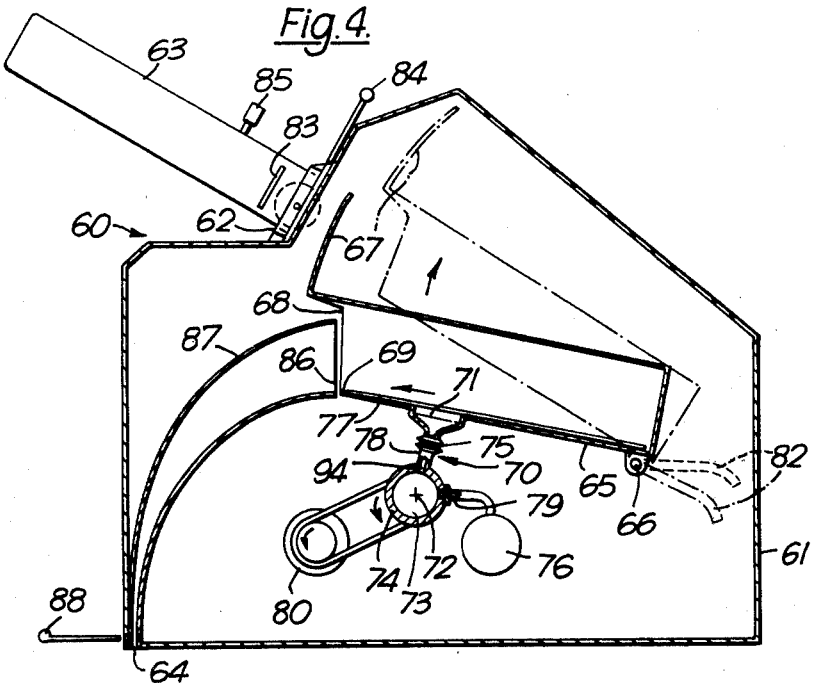

A second embodiment of the invention incorporating a so called 'pitch fork' arrangement for extracting microfiches singly from a stack, is shown in FIG. 4.

In the handling device 60 shown in FIG. 4 which as a light proof container or casing 61, a reception means including a light proof opening 62 for a cassette 63 and ejection opening 64 similar to the first embodiment (although the device ejects downwardly instead of horizontally), a microfiche receiving chamber 65 is pivotal at 66 from a loading position shown in broken lines to an extraction position shown in firm lines.

The chamber 65 has a loading gate 67 provided on the upper side of its mouth 68 which prevents microfiches droping from the cassette 63 into the casing in the case of misalignment of the mouth 68 with the opening 62. The chamber 65 also has a slot 69 in its floor through which an extraction means generally shown at 70 grips the lowermost microfiche of a stack in the chamber 65.

The extraction means 70 consists of a suction head 71 rotatable about an axis 72. The interior of the suction head is in communication with a chamber 73 within a cylindrical valve body 74 by means of a port 94, and is also in communication by means of a port 79 when in the position shown in FIG. 4 with a suction pump 76. The stem 78 connecting the head 71 to the body 74 is provided with a flexible contracting and expanding link 75. The body 74 can be driven by means of a motor 80.

When loading the chamber 65 from the cassette 63 the chamber is brought into its loading position by depression of loading handl 82 and slides 83 and 84 on the cassette and opening 62 are opened, a stack of microfiches is released by knob 85 on the cassette 63 which fall into the chamber 65. The handle 82 is released and the lowest microfiche 77 of the stack engages suction head 71.

As soon as microfiches are required to be fed into a developer, motor 80 is activated which rotates head 71 and slides the bottom microfiche 77 through a gate 86 into an ejection chute 87 which directs the microfiche to the ejection opening 64, past a previously opened slide 88.

When the head rotates several degrees past the position shown in FIG. 4 the port 79 is opened to atmosphere and the vacuum is released allowing the head 71 to disengage itself from the microfiche 77 which continues on into the chute 87.

Although the extraction means 70 is shown with an external port 79 it can equally have an internal porting system formed in an internal cylindrical hollow sleeve which forms a bearing for body 74 and the port 79 is in the hollow sleeve. The vacuum pump 76 is connected to the internal sleeve.

I claim:

1. A device for handling microfiches comprising a light proof container, reception means for receiving a microfiche cassette on or in the container including a light proof reception opening, a microfiche receiving chamber capable of receiving a stack of microfiches from the reception means, said chamber being pivotally mounted towards one end adjacent the reception means on one end of a lever which is pivotally mounted at its other end to a static part of the device, wherein the lever is biassed by means of a resilient means to engage with a cam, and wherein a fixed clamping surface is provided onto which the resilient means biasses the chamber to form a clamping means, the cam on rotation urging the chamber away from the clamping surface;

an ejection opening in the container including a light proof seal, extraction means for removing the microfiches singly from the chamber and feeding the microfiches singly to the ejection opening for ejection into a developing unit, said clamping means arranged to clamp a stack of microfiches held in the receiving chamber so that after a single microfiche has been removed from the stack for feeding to the ejection opening, the remainder of the stack is held in the chamber.

2. A device as claimed in claim 1 wherein there is provided a loading means arranged to overcome the bias of the resilient means and disengage the lever from the cam.

3. A device as claimed in claim 2 wherein the loading means comprises an arm engaging or linked with said one end of the lever, the arm being pivotally mounted on a static part of the device and being movable by a handle on the exterior of the casing to bring the chamber into line with the reception means.

4. A device as claimed in claim 1 wherein the extraction means comprises one or more rollers.

5. A device as claimed in claim 1 wherein the extraction means are driven from a motor energised by an electrical circuit in the developer.

6. A device as claimed in claim 1 comprising a device in the chamber indicating whether the chamber is empty or full.

* * * * *